US006478247B2

(12) United States Patent
Fujiwara et al.

(10) Patent No.: US 6,478,247 B2
(45) Date of Patent: Nov. 12, 2002

(54) METHOD FOR WINDING COPPER FOIL ON CORE TUBE

(75) Inventors: Kazuhisa Fujiwara, Ageo (JP); Naotomi Takahashi, Ageo (JP)

(73) Assignee: Mitsui Mining & Smelting Co., Ltd., Saitama (JP)

( * ) Notice: Subject to any disclaimer, the term of this patent is extended or adjusted under 35 U.S.C. 154(b) by 0 days.

(21) Appl. No.: 09/878,256

(22) Filed: Jun. 11, 2001

(65) Prior Publication Data

US 2002/0027179 A1 Mar. 7, 2002

(30) Foreign Application Priority Data

Jul. 18, 2000 (JP) ..... 2000-216925

(51) Int. Cl.[7] ..... B65H 19/28; B65H 75/28
(52) U.S. Cl. ..... 242/532.3; 242/583
(58) Field of Search ..... 242/532.3, 444.1, 242/444.2, 444.3, 444.4, 444.5, 583; 156/187, 188, 459

(56) References Cited

U.S. PATENT DOCUMENTS

| | | | | | |
|---|---|---|---|---|---|
| 3,321,149 | A | * | 5/1967 | Andersen et al. | 242/583 |
| 3,796,388 | A | * | 3/1974 | Davis | 242/532.3 |
| 4,422,586 | A | * | 12/1983 | Tetro | 242/532.3 |
| 4,912,510 | A | * | 3/1990 | Iwai | 242/583 |
| 5,601,243 | A | * | 2/1997 | Inagaki | 242/532.3 |
| 6,086,010 | A | * | 7/2000 | Kayser | 242/532.3 |

FOREIGN PATENT DOCUMENTS

| | | | | |
|---|---|---|---|---|
| JP | 5-116818 | * | 5/1993 | 242/532.3 |

* cited by examiner

*Primary Examiner*—John M. Jillions
(74) *Attorney, Agent, or Firm*—Roberts & Mercanti, LLP

(57) ABSTRACT

To provide a copper foil roll, which is a final product form of copper foil, in which wrinkles generating in the vicinity of a core tube of the copper foil roll are restrained to the utmost, and a better winding balance is provided. A method for winding copper foil on a core tube, in which the copper foil is spliced to a core tube with use of a pressure-sensitive double-sided adhesive coated tape with releasing paper and is wound into a roll form.

20 Claims, 7 Drawing Sheets

PRIOR ART schematic view showing splicing copper foil to a core tube schematic side view take in the direction A

METHOD FOR WINDING COPPER FOIL ON CORE TUBE

BACKGROUND OF THE INVENTION

The present invention relates to a method for winding copper foil on a core tube.

BACKGROUND ART

In a conventional method for winding copper foil on a core tube, as shown in FIG. 1, what is called a pressure-sensitive double-sided adhesive coated tape, which is commercially available, with a width of about 30 mm is affixed to one place on the core tube, and an end portion of the copper foil is bonded to the tape, by which splicing work is finished, and thereafter the copper foil is wound while the core tube is rotated, whereby the manufacturing work for a copper foil roll is performed.

After the manufacturing work is finished, the roll-form copper foil is wrapped with a plastic film to prevent the copper foil from being exposed to the outside atmosphere, and then is put into a goods-delivery box to reduce the influence of vibrations and to prevent damage during transportation, whereby the copper foil roll is shipped to a user.

The reason why the pressure-sensitive double-sided adhesive coated tape is used to splice the copper foil being wound to the core tube is as described below. The core tube for copper foil is used as an article repeatedly used between a copper foil manufacturer and a laminator or an etching maker., i.e. PCB shop, who use copper foil. Inevitably, therefore, the copper foil must be spliced easily to the core tube, and moreover must be peeled off and removed easily from the core tube.

However, in the work for winding copper foil, for copper foil with a nominal thickness of 70 $\mu$m, a length of 700 m to 1000 m of copper foil is sometimes wound, and for copper foil with a nominal thickness of 18 $\mu$m, a length of 2000 m to 3000 m is sometimes wound. Therefore, poor winding accuracy presents various problems.

For example, if the copper foil is wound loosely on the core tube, and the winding tightness of copper foil is nonuniform at the right and left, the copper foil is loosened by vibrations occurring when the copper foil is transported in a vehicle, so that the core tube slips out of place, which poses a problem in that the copper foil cannot be used by the user.

Also, even if the copper foil roll manufactured by winding copper foil with a nominal thickness of 18 $\mu$m or smaller on the core tube could be used by the user without trouble, when the spliced condition of the copper foil and core tube is not good, wrinkles sometimes generate in the copper foil in the range of about 100 m from the core tube, which sometimes produces a portion unusable as a copper-clad laminate.

Further, in manufacturing the copper-clad laminate, a continuous laminating process (sometimes referred to as a roll-to-roll process) has been used in which glass cloth reeled out of a glass cloth roll is impregnated with an insulating resin, and the impregnated glass cloth is directly lapped on copper foil reeled out of a copper foil roll and is cured by heating in an oven, by which the copper-clad laminates are manufactured continuously. In this method, the winding accuracy of copper foil roll is a very important factor contributing to improvement in yields.

SUMMARY OF THE INVENTION

Thereupon, the inventors of the present invention earnestly conducted a study and found that the first stage of winding of copper foil on a core tube, that is, a first layer of copper foil wound on the core tube while the core tube is rotated is very important as a factor determining the winding accuracy of copper foil. The method for winding copper foil on the core tube, described below, was carried out based on the above-described knowledge.

Herein there is described a method for winding copper foil on a core tube, in which copper foil is spliced to a core tube by using a pressure-sensitive double-sided adhesive coated tape with releasing paper and is wound into a roll form, comprising the steps of affixing a first pressure-sensitive double-sided adhesive coated tape with releasing paper, which has a length equal to the width of copper foil being wound and a width of 15 to 50 mm to the outer peripheral surface of the core tube so that the lengthwise direction of the tape is parallel with the longitudinal axis of the core tube; affixing a second pressure-sensitive double-sided adhesive coated tape with releasing paper, which has a length equal to that of the first pressure-sensitive double-sided adhesive coated tape with releasing paper and a width of 15 to 50 mm to the outer peripheral surface of the core tube, like the first pressure-sensitive double-sided adhesive coated tape with releasing paper, so as to be adjacent to the winding rotation side of the first pressure-sensitive double-sided adhesive coated tape with releasing paper; removing a releasing paper of the first pressure-sensitive double-sided adhesive coated tape with releasing paper, and affixing a winding-start end portion of the copper foil to the first pressure-sensitive double-sided adhesive coated tape with releasing paper in such a manner that the winding-start end portion of the copper foil does not cover the second pressure-sensitive double-sided adhesive coated tape with releasing paper; removing a releasing paper of the second pressure-sensitive double-sided adhesive coated tape with releasing paper, rotating the core tube one substantially complete turn in a state in which the copper foil is under tension, and ceasing the rotation temporarily at a position at which the copper foil laps on the second pressure-sensitive double-sided adhesive coated tape with releasing paper; bonding the copper foil to the core tube by applying a pressure to a bonding portion so that the copper foil bonds sufficiently to the second pressure-sensitive double-sided adhesive coated tape with releasing paper, thereby performing splicing operation in which the copper foil on the winding-start end portion side is wound and fixed on the core tube; and winding the copper foil into a roll form.

In describing the method for winding copper foil on a core tube defined in herein the description will be made with reference to FIGS. 2, 3 and 4 for ease of understanding.

Figures 1A, 1B:
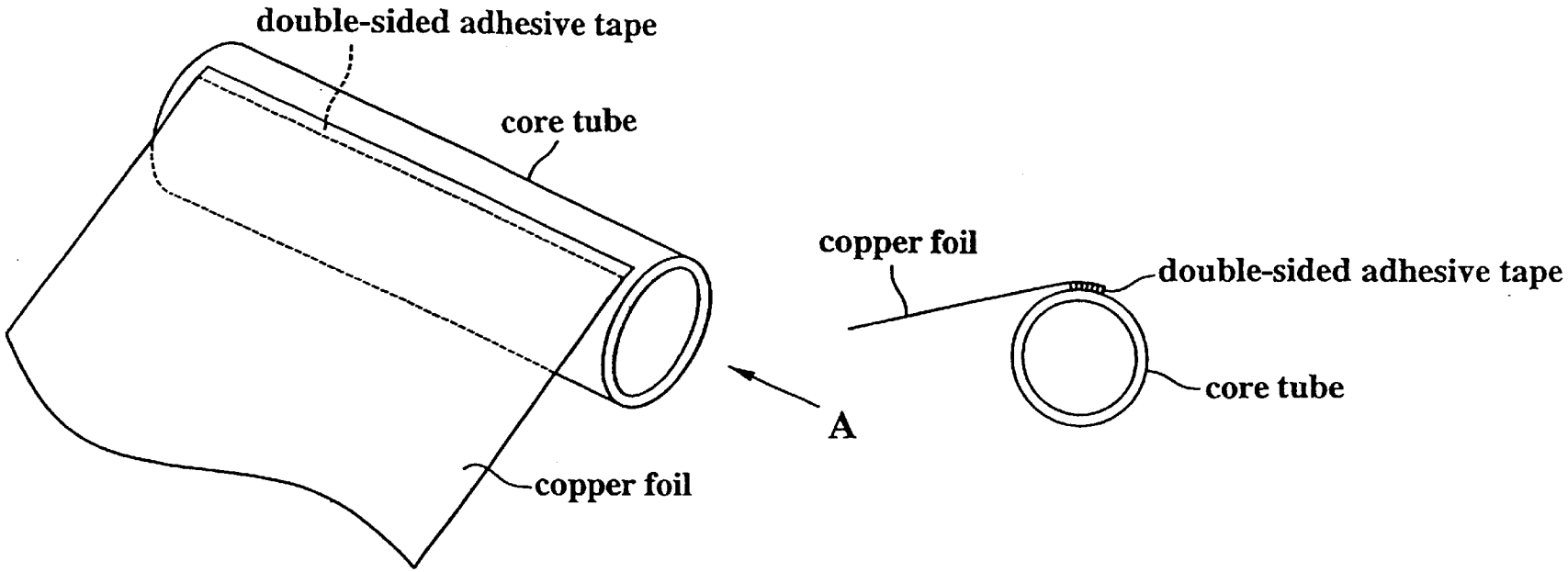
FIG. 1 is a schematic view showing a basic method for splicing copper foil to a core tube.
Figure 2:
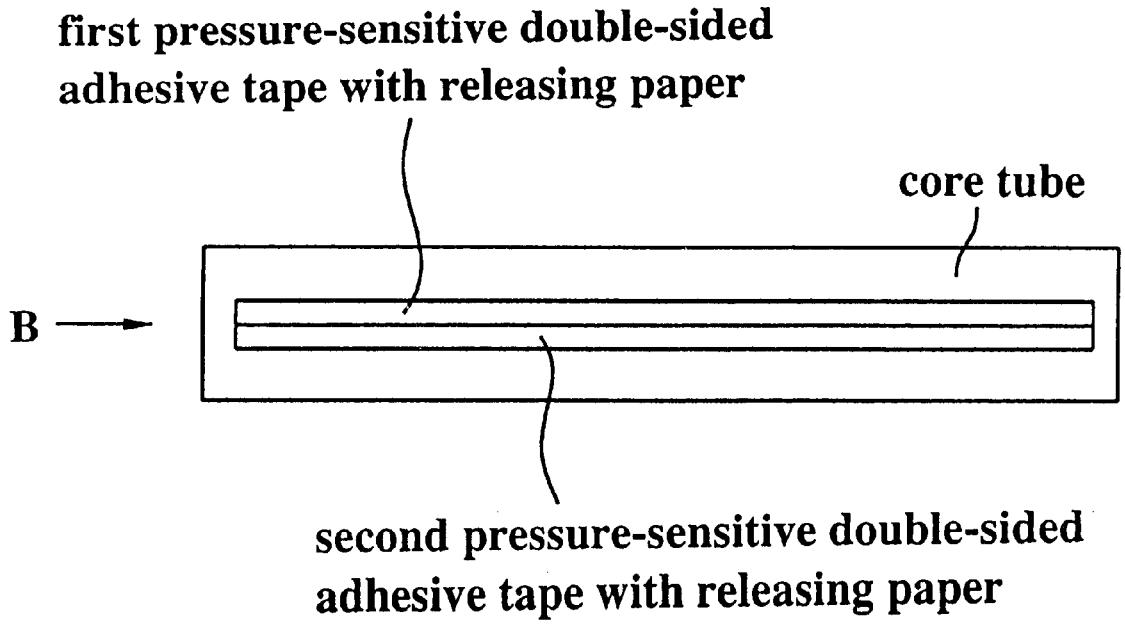
FIG. 2 is a schematic view showing a position at which pressure-sensitive double-sided adhesive coated tapes with releasing paper are affixed to a core tube.

FIG. 2 shows a state of the core tube after the first and second pressure-sensitive double-sided adhesive coated tapes with releasing paper are affixed to the core tube to give an understanding of the positional relationship between the first and second pressure-sensitive double-sided adhesive coated tapes with releasing paper. The core tube is rotated in the direction indicated by the arrow C of FIG. 3(*b*). FIGS. 3 and 4 show a procedure for splicing the copper foil to the core tube using schematic side views of the core tube taken in the direction of the arrow B of FIG. 2.

Therefore, the following description will be made with reference to FIGS. 3 and 4. FIG. 3(*a*) is a schematic side view showing a state in which the first pressure-sensitive double-sided adhesive coated tape with releasing paper is affixed to the outer peripheral surface of the core tube. The length of the first pressure-sensitive double-sided adhesive coated tape with releasing paper is equal to the width of the copper foil being wound, and the copper foil is configured so that the whole in the transverse direction of copper foil is affixed uniformly to the core tube. The first pressure-sensitive double-sided adhesive coated tape with releasing paper preferably has a width of 15 to 50 mm. The use of the tape with a width narrower than 15 mm cannot provide a sufficient bonding strength between the core tube and the copper foil, so that the copper foil cannot be wound under high tension. On the other hand, the use of the first pressure-sensitive double-sided adhesive coated tape with releasing paper with a width exceeding 50 mm makes it difficult to affix the copper foil to the tape uniformly without the formation of wrinkles, so that it is difficult to perform the intended highly accurate winding.

The first pressure-sensitive double-sided adhesive coated tape with releasing paper is affixed to the outer peripheral surface of the core tube in parallel with the core tube, strictly speaking, in parallel with the longitudinal axis of the core tube as described herein. It is therefore preferable that the work be done using a jig so that the position at which the first pressure-sensitive double-sided adhesive coated tape with releasing paper is affixed is made definite. This is because this work is a first factor in determining whether or not the copper foil can be wound perpendicularly and uniformly with respect to the core tube.

After the first pressure-sensitive double-sided adhesive coated tape with releasing paper has been affixed to the outer peripheral surface of the core tube, the second pressure-sensitive double-sided adhesive coated tape with releasing paper is likewise affixed to the outer peripheral surface of the core tube so as to be adjacent to the first pressure-sensitive double-sided adhesive coated tape with releasing paper. The state at this time is shown in FIG. 3(*a*). The second pressure-sensitive double-sided adhesive coated tape with releasing paper has a width of 15 to 50 mm and a length equal to the width of the copper foil being wound, like the first pressure-sensitive double-sided adhesive coated tape with releasing paper. However, the first and second pressure-sensitive double-sided adhesive coated tapes with releasing paper need not always have the same width. For example, considering the thickness and winding length of the copper foil, the first pressure-sensitive double-sided adhesive coated tape with releasing paper with a width of 30 mm and the second pressure-sensitive double-sided adhesive coated tape with releasing paper with a width of 25 mm may be used.

Figure 3A:
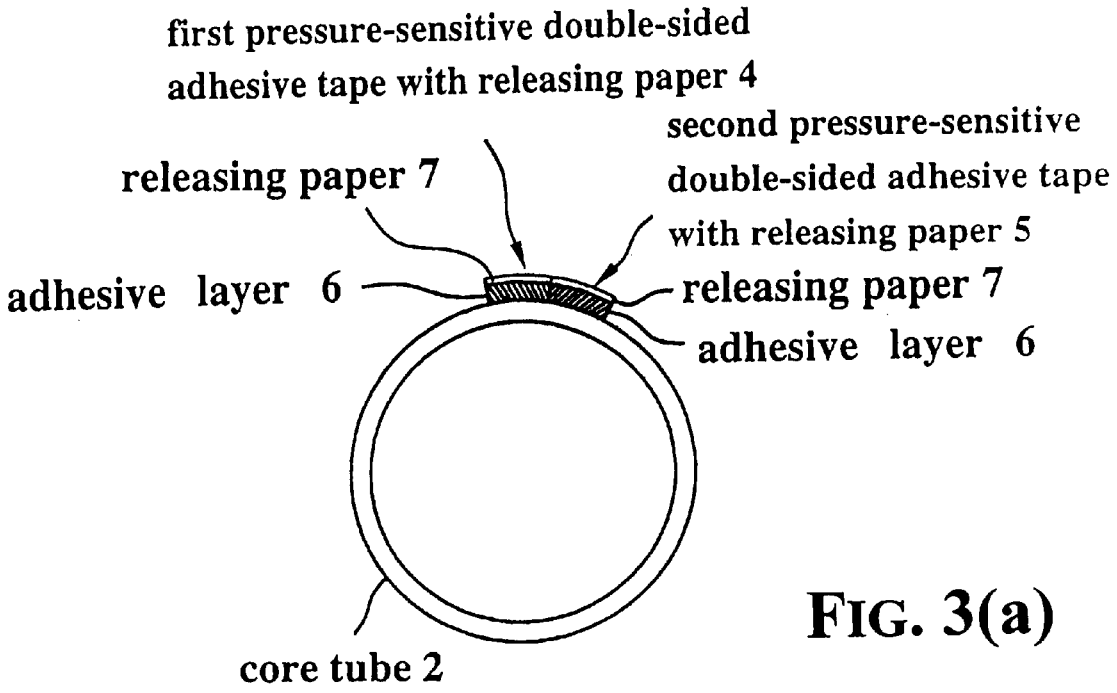
FIGS. 3 and 4 are schematic views showing a procedure for winding copper foil on a core tube, viewed from the side.
Figure 3B:
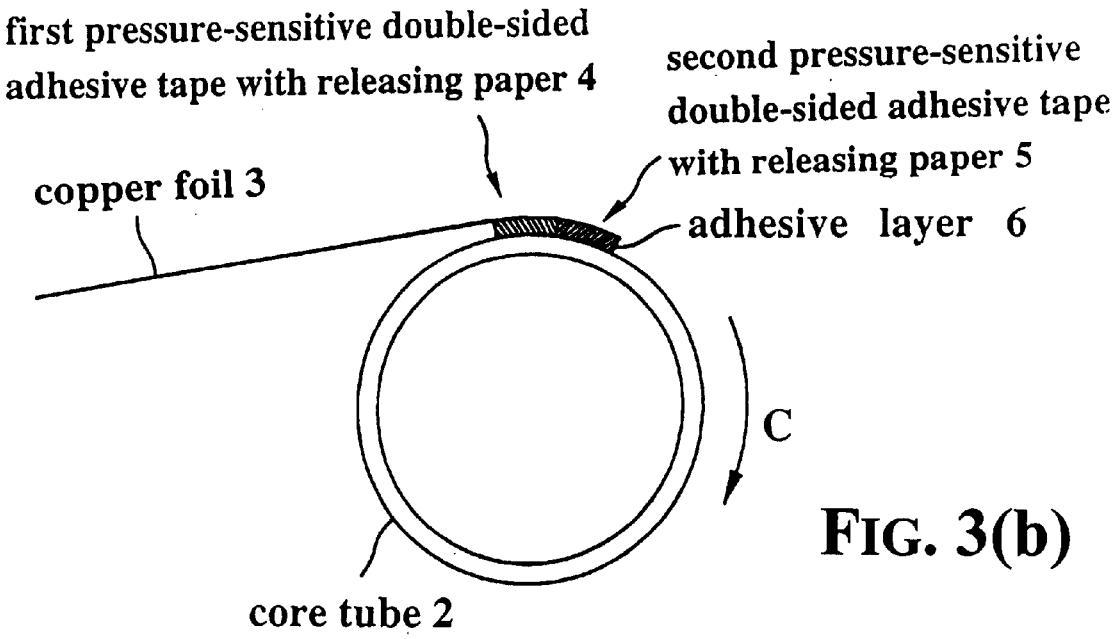

After the first and second pressure-sensitive double-sided adhesive coated tapes with releasing paper have been affixed to the outer peripheral surface of the core tube, as shown in FIG. 3(*b*), the winding-start end portion of the copper foil to be wound is first adhered to the first pressure-sensitive double-sided adhesive coated tape with releasing paper. Specifically, the releasing paper (sometimes referred to as a "separator") of the first pressure-sensitive double-sided adhesive coated tape with releasing paper is peeled off and removed, and the winding-start end portion of the copper foil to be wound is affixed thereto uniformly without the formation of wrinkles while attention is paid to the prevention of foreign matters from getting in between the bonding surfaces and then is bonded by applying a sufficient pressure. At this time, the winding-start end portion of the copper foil should not cover the second pressure-sensitive double-sided adhesive coated tape with releasing paper. At this stage, the releasing paper of the second pressure-sensitive double-sided adhesive coated tape with releasing paper is peeled off and removed.

In the state in which the releasing paper of the second pressure-sensitive double-sided adhesive coated tape with releasing paper has been peeled off as described above, tension is given to the copper foil to be wound, and the core tube is rotated one substantially complete turn. After the core tube has been rotated one substantially complete turn, the copper foil being wound laps on the second pressure-sensitive double-sided adhesive coated tape with releasing paper from which the releasing paper has been peeled off. At this lapping position, the rotation of the core tube is ceased while tension is still given to the copper foil, and the copper foil is affixed sufficiently to the second pressure-sensitive double-sided adhesive coated tape with releasing paper under pressure. Thus, as shown in FIG. 4(*c*), the copper foil wound on the core tube can bring about a spliced state in which the copper foil is wound and fixed without a gap developed between the core tube and the copper foil wound on the core tube. Thereafter, the copper foil is wound into a roll form by the ordinary method while constant or controlled tension is given to the copper foil, by which the state shown in FIG. 4(*d*) is brought about. In FIG. 4(*d*), the pressure-sensitive double-sided adhesive coated tapes are shown so as to be extremely thick because this figure is a schematic view. Actually, however, in the state of copper foil roll, it is difficult to visually observe the state in which the copper foil floats in the vicinity of the tapes.

Ideally, the pressure-sensitive double-sided adhesive coated tapes should preferably be affixed to the whole surface of the core tube, and the copper foil should preferably be affixed to the whole of outer peripheral surface of the core tube. However, for the copper foil, which is a metallic material, copper foil with a nominal thickness of about 9 $\mu$m to 90 $\mu$m is generally supplied to the market, so that wrinkles generate in the copper foil more easily than in paper or plastic film. Therefore, it is very difficult to affix the copper foil to the whole of outer peripheral surface of the core tube uniformly without the formation of wrinkles. For this reason, the inventors have made the present invention to provide a method in which the area in which the copper foil is bonded to the core tube is made at a minimum, and the copper foil can be wound and fixed on the core tube reliably without a gap developed between the core tube and the first layer of the copper foil being wounded.

In the case where the copper foil is spliced to the core tube as described above to manufacture the copper foil roll, highly accurate winding of copper foil can be carried out. The use of the above-described splicing method for copper foil brings about a state in which the first layer of the copper foil, which is a start portion for winding on the core tube, adheres closely to the outer peripheral surface of the core tube substantially completely, so that air can be prevented from getting into the boundary between the core tube and the copper foil.

Figure 5:
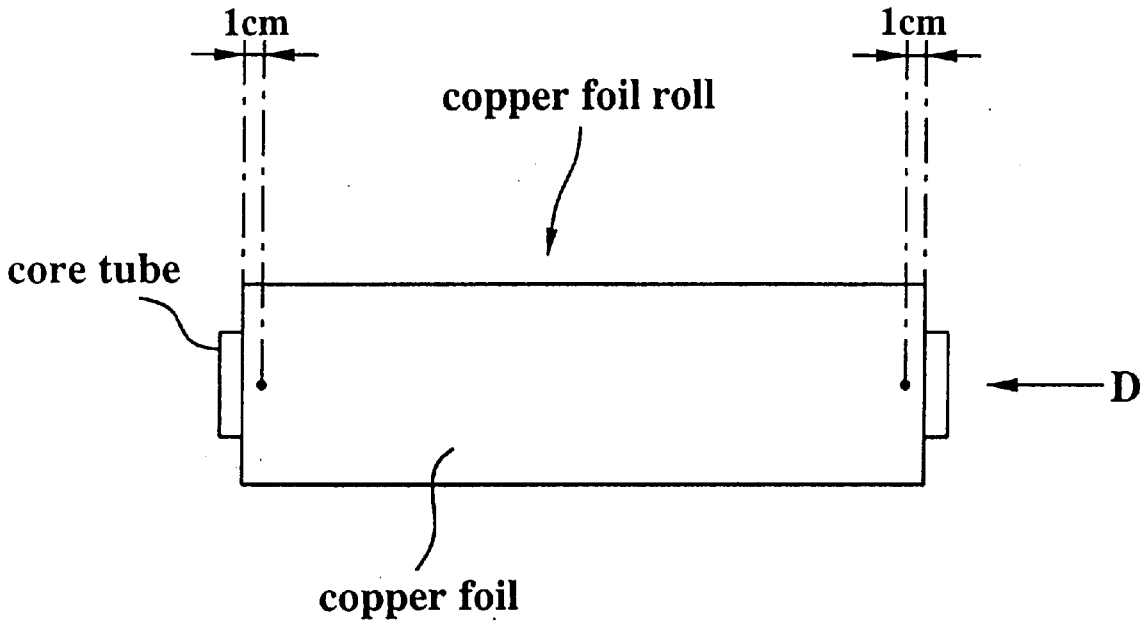
FIGS. 5 and 6 are schematic views showing methods for evaluating the winding accuracy of copper foil.
Figure 5:
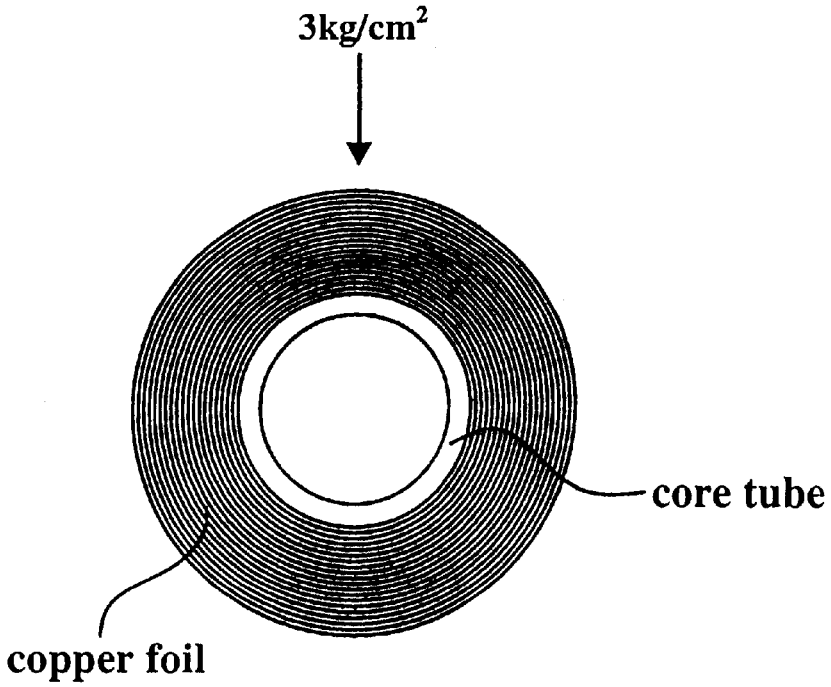

The evaluation of winding accuracy was performed by the evaluation of winding tightness of copper foil roll and the measurement of a length in which wrinkles generated in the copper foil on the winding core side. In the evaluation of winding tightness of copper foil roll, as shown in FIG. 5, at the stage at which the winding process for copper foil had been finished, portions located at a distance of 1 cm from both edges of the manufactured copper foil roll were pushed in with a force of 3 kg/cm$^2$, pushed-in distances at both edges were measured, and an absolute value of a difference between the pushed-in distances at both edges was determined, the obtained value being made an index of winding balance. In the case where the difference between pushed-in distances is within 3 mm, the copper foil was appraised high as copper foil having a good winding balance. Hereafter, this difference between pushed-in distances is referred to as an "A evaluation value". When the winding process was done using a paper core with an outside diameter of 110 mm by the conventional method, the mean value and the standard deviation of A evaluation values of 100 rolls were 4.6 mm and 0.71, respectively.

Figure 6:
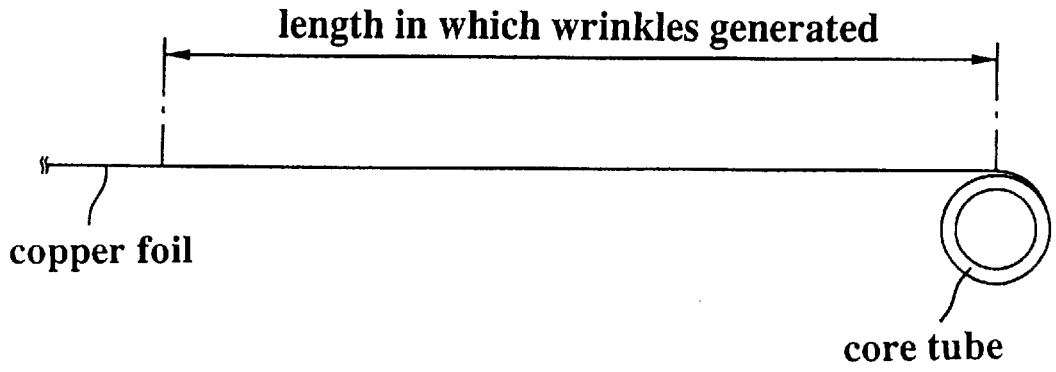

In the measurement of a length in which wrinkles generate in the copper foil on the winding core side, a copper foil roll in which copper foil with a nominal thickness of 18 $\mu$m was wound was shipped to a user, copper foil of 200 m on the winding core side was left after the copper foil roll had been used to manufacture copper-clad laminates, and the left copper foil was returned in a state of being wound on the core tube, by which a length in which wrinkles generated in the copper foil from the splice portion was measured as shown in FIG. 6. When the winding process was done using a paper core with an outside diameter of 110 mm by the before-mentioned conventional method, not by the method in accordance with the present invention, the mean value and the standard deviation of lengths in which wrinkles generated of 100 rolls were 145 m and 10.6, respectively. Hereafter, the length in which wrinkles generated is referred to as a "B evaluation value".

By using the splicing method in accordance with the present invention, a copper foil roll was manufactured by winding copper foil with a nominal thickness of 18 $\mu$m, a winding width of 1150 mm, and a winding length of 1800 m on a paper core with an outside diameter of 110 mm and a length of 1200 mm, and the same evaluation as described above was performed. As the result, very satisfactory results were obtained. Here, the mean values of evaluation results for 10 rolls are described. The mean value and the standard deviation of A evaluation values were 2.8 mm and 0.08, respectively, and the mean value and the standard deviation of B evaluation values were 105 m and 6.85, respectively. The mean values of both evaluation values were far lower than those obtained by the conventional method, showing very satisfactory values. The standard deviations, which are indexes indicating variations, were also lower, which revealed that variations in winding process for copper foil decreased.

Herein there is described the method for winding copper foil on a core tube, wherein the first and second pressure-sensitive double-sided adhesive coated tapes with releasing paper each comprise a releasing paper and an adhesive layer with a thickness of 30 to 50 $\mu$m. In the above description, "comprise a releasing paper and an adhesive layer with a thickness of 30 to 50 $\mu$m" means a type in which a base material is not used for a bonding layer, like the bonding layer of the pressure-sensitive double-sided adhesive coated tape normally on the market, and means a type in which the bonding layer is formed of only a pressure sensitive adhesive. For the above-described bonding layer without the use of the base material, the thickness as a bonding layer can be kept small, and the adhesive layer can be allowed to flow by applying a pushing pressure at the time of bonding, so that a smaller bonding layer thickness can be provided.

Therefore, by the use of such pressure-sensitive double-sided adhesive coated tapes, a rise of a splicing portion of the core tube and the copper foil is reduced to the utmost, and a more uniform winding state is attained. As the winding length of copper foil increases and therefore the weight of copper foil having been wound increases, the copper foil weight imposes a load on the core tube, which causes deflection of the core tube, and causes delicate eccentricity of the core tube rotating during the winding process. In particular, the weight of copper foil having been wound is concentrated on a top portion of the core tube rotating during the winding process. If the rise of the splicing portion caused by the pressure-sensitive double-sided adhesive coated tapes reaches a level higher than a given level at the moment when the portion in which the copper foil is spliced with the pressure-sensitive double-sided adhesive coated tapes is positioned at the top portion, the load stresses concentrate on the splicing portion, which seems to be a major cause for deflecting the core tube during the winding process.

For such a reason, the thickness of the pressure sensitive adhesive layer is made 10 to 50 $\mu$m. If the thickness of the pressure sensitive adhesive layer is smaller than 10 $\mu$m, it is difficult to ensure a safe bonding strength in the case where the winding of the copper foil on the core tube is considered. On the other hand, if the thickness of the pressure sensitive adhesive layer exceeds 50 $\mu$m, even if the thickness is one after the adhesive is allowed to flow by applying a pushing pressure, the winding accuracy in the case where a thin copper foil with a nominal thickness of 18 $\mu$m or smaller is wound is decreased by the above-described eccentricity of core tube or by other causes.

By using the pressure-sensitive double-sided adhesive coated tapes with releasing paper, a copper foil roll was manufactured by winding copper foil with a nominal thickness of 18 $\mu$m, a winding width of 1150 mm, and a winding length of 1800 m on a paper core with an outside diameter of 110 mm and a length of 1200 mm, and the same evaluation as described above was performed. As the result, very satisfactory results were obtained. Here, the mean values of evaluation results for 10 rolls are described. The mean value and the standard deviation of A evaluation values were 2.4 mm and 0.07, respectively, and the mean value and the standard deviation of B evaluation values were 95 m and 6.27, respectively. The mean values of both evaluation values were far lower than those obtained by the conventional method, showing very satisfactory values. The standard deviations, which are indexes indicating variations, were also lower.

Herein, there is described the method for winding copper foil on a core tube, wherein the core tube has an outside diameter of 110 to 350 mm and a roundness of 150 $\mu$m or less. The reason why the core tube has an outside diameter of 110 to 350 mm is as described below. To increase the accuracy of winding of the copper foil on the core tube, it is found that the use of core tube with a larger diameter (core tube diameter) is preferable. Based on this fact, even if the above-described splicing method is used, the use of the core tube with an outside diameter smaller than 110 mm makes it difficult to wind the copper foil on the core tube without the formation of wrinkles in the copper foil, which is the object of the present invention. Although it is clearly described that the upper limit value of outside diameter of the core tube is 350 mm, the upper limit value is not subject to any special restriction as described above. The value of 350 mm is a value obtained simply as the result of consideration of workability and handling ability.

Rather than the outside diameter of core tube, the roundness of a circular shape of core tube in cross section is more important. As the roundness decreases, the circular shape approaches a complete round, so that it is easily supposed that the decreased roundness can increase the winding accuracy of copper foil. However, it is impossible in reality to make the circular shape a complete round. As described above, the weight of copper foil having been wound is as high as about several hundred kilograms, which deflects the core tube. Therefore, unless the core tube has a roundness of a given level, the winding accuracy of copper foil cannot be improved further. In this specification, the roundness is defined as a value representing a difference between the maximum and minimum diameters obtained by measuring the diameter of core tube a plurality of times at different locations. Therefore, the roundness is affected by the outside dimension. In this description, a core tube with an outside diameter of 110 to 350 mm is assumed.

Thereupon, the inventors of the present invention earnestly conducted a study on the relationship between the roundness of core tube and the winding accuracy of copper foil. As the result, it was found that unless the core tube with a roundness of 150 $\mu$m or less is used, the winding accuracy of copper foil cannot be increased, and therefore the copper foil winding accuracy of a level at which the above-described effects can be achieved cannot be obtained. Although the material of the core tube is not subject to any special restriction in the present invention, it has been revealed that for example, in order to keep the deflection of core tube due to the copper foil weight exceeding 200 kg to a minimum, it is preferable to use a core tube using FRP (fiber reinforced plastics) or a metal tube or metal core formed of stainless steel or the like, not a core tube formed of paper (paper core). Furthermore, in order to attain the roundness referred to herein, it is preferable to use the FRP tube or metal tube rather than paper core. Incidentally, the paper cores used when the effects were confirmed had a roundness of 158 $\mu$m, which does not satisfy the roundness requirement of the invention.

By using the FRP core tube with an outside diameter of 110 mm, a length of 1200 mm, and a roundness of 100 $\mu$m, a copper foil roll was manufactured using copper foil with a nominal thickness of 18 $\mu$m, a winding width of 1150 mm, and a winding length of 1800 m, and the same evaluation as described above was performed. As the result, very satisfactory results were obtained. Here, the mean values of evaluation results for 10 rolls are described. The mean value and the standard deviation of A evaluation values were 2.1 mm and 0.05, respectively, and the mean value and the standard deviation of B evaluation values were 72 m and 4.55, respectively. It was found that the mean values of both evaluation values were also lower than those obtained by not only the conventional method but also the methods in accordance with the above-described present invention, showing very satisfactory values, and the standard deviations, which are indexes indicating variations, were also lower.

Herein, there is described the method for winding copper foil on a core tube 3, wherein the core tube has an outer peripheral surface with a surface roughness (Rmax) of 10 to 30 $\mu$m. The reason for specifying such a surface roughness of core tube is that the amount of air getting in between the outer peripheral surface of the core tube and the copper foil being wound changes depending on the surface roughness, so that the copper foil cannot be wound and fixed on the core tube uniformly. When a core tube whose surface roughness of outer peripheral surface is controlled is used, the use of an FRP or metallic core tube is immensely advantageous.

The inventors of the present invention earnestly conducted a study and found that the use of a core tube with a surface roughness (Rmax) of 30 $\mu$m and less provides a copper foil roll in which both of the above-described A and B evaluation values vary less and are stable, and high winding accuracy that has not been obtained by the conventional method can be attained. The lower limit, which is not thought to need to be subject to any special restriction, should preferably be a value of a level shown in this specification considering the finish accuracy of the core tube. By using the FRP core tube with an outside diameter of 110 mm, a length of 1200 mm, a roundness of 80 $\mu$m, and an outer peripheral surface roughness (Rmax) of 21 $\mu$m in accordance with claim 4, a copper foil roll was manufactured using copper foil with a nominal thickness of 18 $\mu$m, a winding width of 1150 mm, and a winding length of 1800 m, and the same evaluation as described above was performed with the results as described below. Here, the mean values of evaluation results for 10 rolls are described. The mean value and the standard deviation of A evaluation values were 1.8 mm and 0.04, respectively, and the mean value and the standard deviation of B evaluation values were 58 m and 3.89, respectively. It was found that the mean values of both evaluation values were also lower than those obtained by not only the conventional method and but also the methods in accordance with the above-described present invention, showing very satisfactory values, and the standard deviations, which are indexes indicating variations, were also lower, so that great winding accuracy could be achieved.

Further, here is described the method for winding copper foil on a core tube wherein variations of area weight in the transverse direction of the copper foil are within 5%. Regarding the methods described above, the studies were conducted mainly from the viewpoint of an increase in the winding accuracy of the copper foil on the core tube in view of the quality, characteristics, and the like of the core tube and the pressure-sensitive double-sided adhesive coated tape with releasing paper. However, the uniformity of thickness of the copper foil being wound is another major factor contributing to an increase in the winding accuracy. If the thickness of the copper foil being wound is nonuniform, it is difficult to achieve really good accuracy.

The copper foil to be wound is broadly divided into electrodeposited copper foil and rolled copper foil. The rolled copper foil is manufactured by stepwise rolling a copper ingot into foil with a thickness on the order of micron while giving a predetermined heat history. At this time, even if the arrangement of top and bottom rolls shifts slightly, large variations in thickness of copper foil sometimes occur considering that the thickness of copper foil is on the order of micron.

Figure 7:
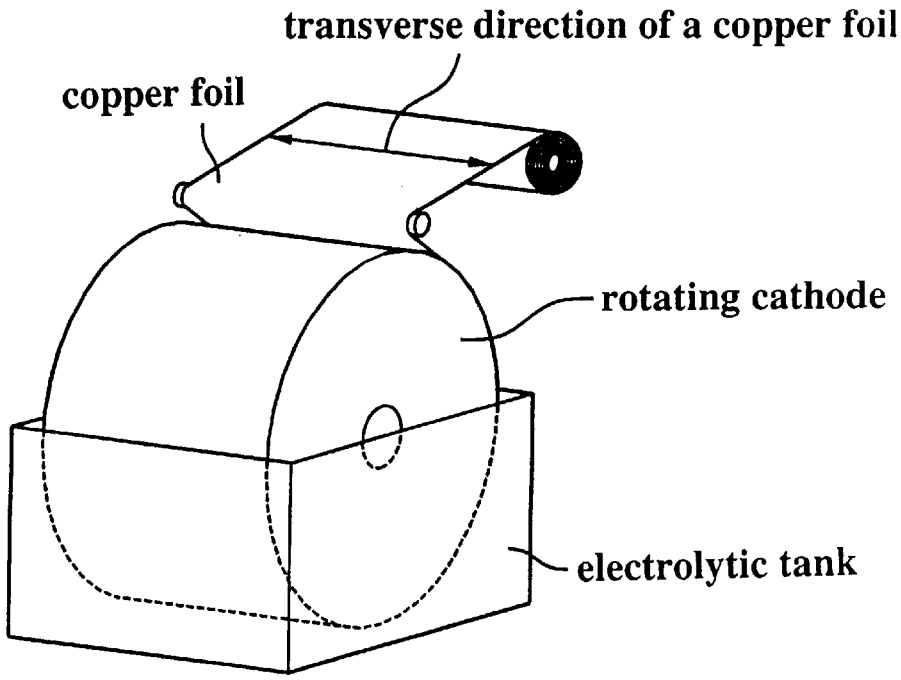
FIG. 7 is a schematic view of copper foil manufactured by an electrolytic method.

Further, the thickness of the electrodeposited copper foil is liable to vary. Untreated foil before being subjected to surface treatment of electrodeposited copper foil is manufactured as described below. Copper sulfate solution is allowed to flow in a gap of about 10 mm between a rotating cathode of a drum shape and a lead-base anode disposed so as to face the rotating cathode along the shape thereof, and copper is deposited on the drum surface of the rotating cathode by utilizing electrolysis. The deposited copper, which forms foil with a width of 1 to 2 m, is continuously peeled off from the rotating cathode and is wound. The thickness in the transverse direction of the copper foil shown in FIG. 7 is liable to vary.

Therefore, it is thought that in order to further increase the winding accuracy of the copper foil on the core tube, the thickness of the copper foil being wound must be uniform. For the variations in thickness of copper foil, in the case where the copper foil is wound into a roll form, variations in two directions, that is, in the width direction, i.e. transverse direction (hereinafter referred to as the TD) and in the lengthwise direction, i.e. machine direction (hereinafter referred to as the MD) of copper foil are thought. The inventors of the present invention earnestly conducted a study and found that in order to increase the winding accuracy of the copper foil on the core tube, it is very useful in improving the A evaluation value to keep the variations in thickness in the TD rather than the MD to a given level.

Figure 8:
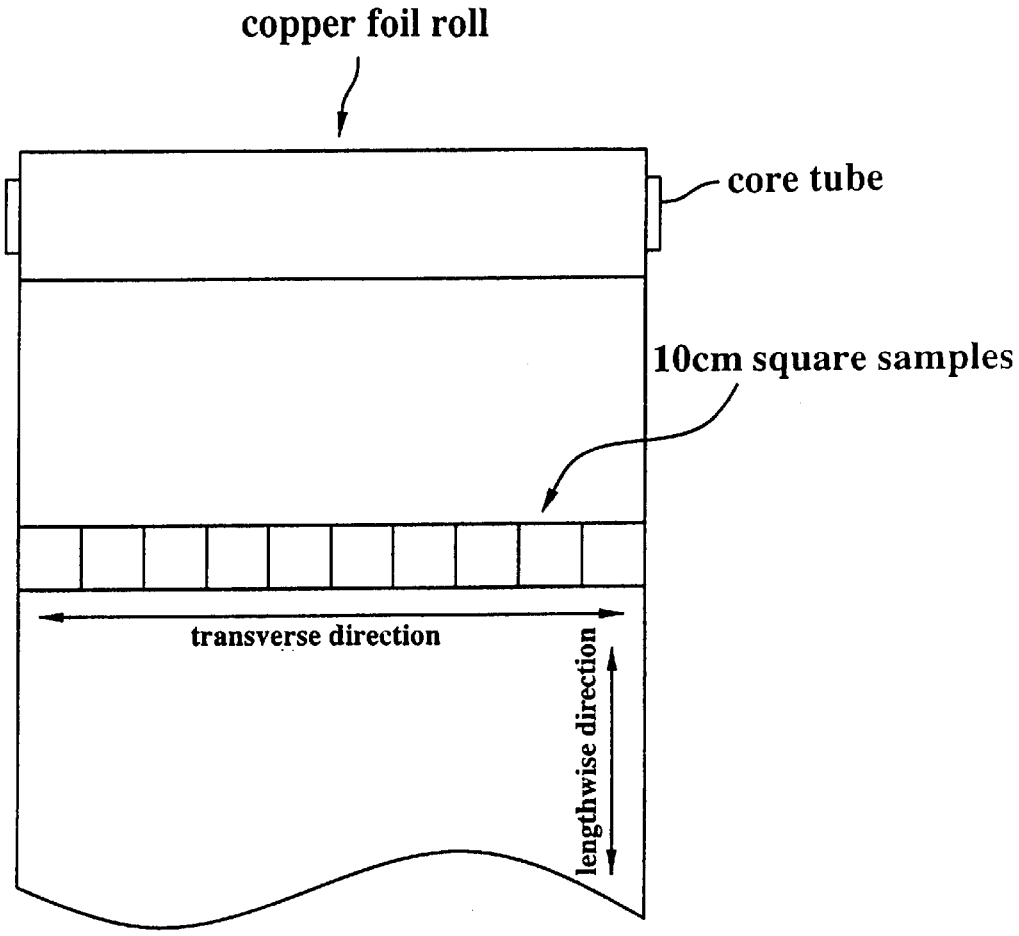
FIG. 8 is a schematic view showing sampling positions for evaluating copper foil area weight in the transverse direction.

Based on the above-described findings, the inventors of the present invention performed a study to see what degree of variation in thickness in the TD can increase the winding accuracy. The study result is given in Table 1. In this study, the variations in thickness in the TD of copper foil was determined as described below. As shown in FIG. 8, 10 cm square samples were cut from one row in the transverse direction of copper foil, and the weight of the sample was measured and converted into area weight per 1 $m^2$ to determine the variations in thickness in the TD. A difference between the maximum area weight and the minimum area weight was used as an index representing the variations in thickness. This is because the thickness of copper foil is generally expressed in terms of area weight. Therefore, "variations in thickness" in this specification are represented as a value obtained by deducting "minimum area weight" from "maximum area weight". Table 1 gives a case where electrodeposited copper foil that has an average area weight of 150 $g/m^2$ after being subjected to surface treatment is used. The winding process conditions in Table 1 were as described below. An FRP core tube with an outside diameter of 110 mm, a length of 1200 mm, a roundness of 52 $\mu$m, and an outer peripheral surface roughness (Rmax) of 18 $\mu$m was used to wind electrodeposited copper foil with a nominal thickness of 18 $\mu$m, a winding width of 1000 mm, and a winding length of 1800 m, by which a copper foil roll was manufactured and evaluated.

TABLE 1

| Variations in thickness ($g/m^2$) | Coefficient of variation with respect to average area weight (%) | A evaluation value (mm) |
|---|---|---|
| 15.0 | 10.0 | 5.6 |
| 10.3 | 6.9 | 3.1 |
| 7.4 | 4.9 | 1.8 |
| 6.0 | 4.0 | 1.5 |
| 3.0 | 2.0 | 0.8 |

As is apparent from Table 1, in a range in which the variations in thickness are 7.4 $g/m^2$ and the coefficient of variation with respect to average area weight is 4.9% or less, the A evaluation value is lower than 2.0 mm. The copper foil roll in which the winding accuracy of this level is achieved is appraised high as a copper foil roll having very high winding accuracy, and copper foil can be reeled out very satisfactorily even in the before-mentioned continuous laminating process for copper-clad laminates. A tendency similar to that given in Table 1 is shown independently of the thickness of copper foil. The study conducted by the inventors of the present invention has revealed that if the variations in area weight in the TD are within 5% with respect to the average area weight, copper foil can be wound to form a proper copper foil roll.

EMBODIMENTS OF THE INVENTION

An embodiment of a method for winding copper foil on a core tube in accordance with the present invention will now be described, and then the effects of the present invention will be described by way of the A and B evaluation values for the copper foil roll obtained by the above-described method. Here, a preferred embodiment of the present invention will be described with reference to FIGS. 3 and 4.

In this embodiment, in order to manufacture a copper foil roll 1, an FRP core tube with an outside diameter of 110 mm, a length of 1200 mm, a roundness of 46 $\mu$m, and an outer peripheral surface roughness (Rmax) of 18 $\mu$m was used as a core tube 2. The core tube 2 was set on a winding drive shaft of a slitter, not shown. On the other hand, copper foil 3 with a nominal thickness of 18 $\mu$m and a coefficient of variation of 4.5% with respect to the average area weight, which had been wound after being subjected to surface treatment, was set on a unwinding drive shaft of the slitter, and both end portions in the TD of the wound copper foil 3 were slit with a circular rotating blade. The copper foil 3 with a width of 1150 mm and a winding length of 1800 m, which had been slit, was wound on the core tube 2 on the winding shaft, by which the copper foil roll 1 was manufactured.

Before the winding operation of the copper foil 3 is started, as shown in FIG. 3(*a*), a first pressure-sensitive double-sided adhesive coated tape with releasing paper 4 and a second pressure-sensitive double-sided adhesive coated tape with releasing paper 5 were affixed to the outer peripheral surface of the core tube 2. At this time, these tapes 4 and 5 were affixed with a not-shown jig, so as to be as parallel as possible with the longitudinal axis of the core tube 2. The lengths of the first pressure-sensitive double-sided adhesive coated tape with releasing paper 4 and the second pressure-sensitive double-sided adhesive coated tape with releasing paper 5 were set to be slightly larger than the width of the copper foil to be wound, and protruding tape portions were cut and removed after the copper foil 3 had been affixed to the tapes.

As the first pressure-sensitive double-sided adhesive coated tape with releasing paper 4 and the second pressure-sensitive double-sided adhesive coated tape with releasing paper 5, the pressure-sensitive double-sided adhesive coated tape 200A-30 manufactured by Kyodo Giken Kagaku Co., Ltd. was used. An adhesive layer was formed of only an adhesive component 30 $\mu$m thick without a base material, and releasing paper had a thickness of 85 $\mu$m and a tape width of 20 mm.

As shown in FIG. 3(*b*), the releasing paper of the first pressure-sensitive double-sided adhesive coated tape with releasing paper 4 and the second pressure-sensitive double-sided adhesive coated tape with releasing paper 5 were removed, and a winding-start end portion of the copper foil 3 to be wound was affixed to the first pressure-sensitive double-sided adhesive coated tape with releasing paper 4 without wrinkles. At the time when this affixing work had been finished, the core tube 2 was rotated slowly while giving tension of 40 kg to the copper foil 3. As shown in FIG. 4(*c*), the rotation of the core tube 2 was ceased at a position at which the copper foil 3 laps on the second pressure-sensitive double-sided adhesive coated tape with releasing paper 5, and a pressure is applied to the second pressure-sensitive double-sided adhesive coated tape with releasing paper 5 from over the copper foil 3 to surely affix the copper foil 3 to the second pressure-sensitive double-sided adhesive coated tape with releasing paper 5 from which the releasing paper had been removed, by which the splicing work in a state in which the copper foil 3 was wound and fixed on the core tube 3 was completed.

Figure 4C:
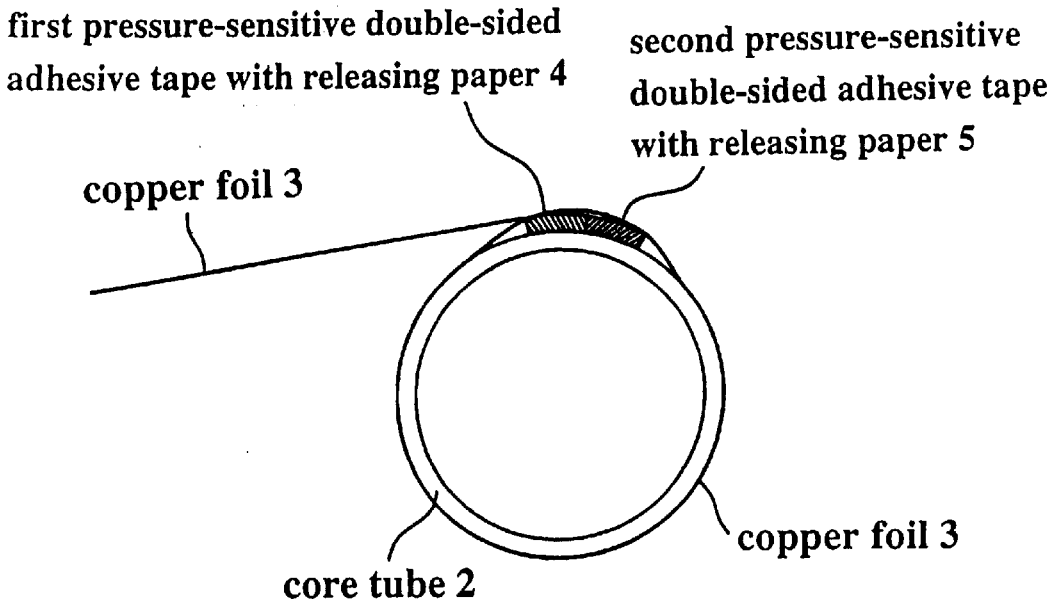
Figure 4D:
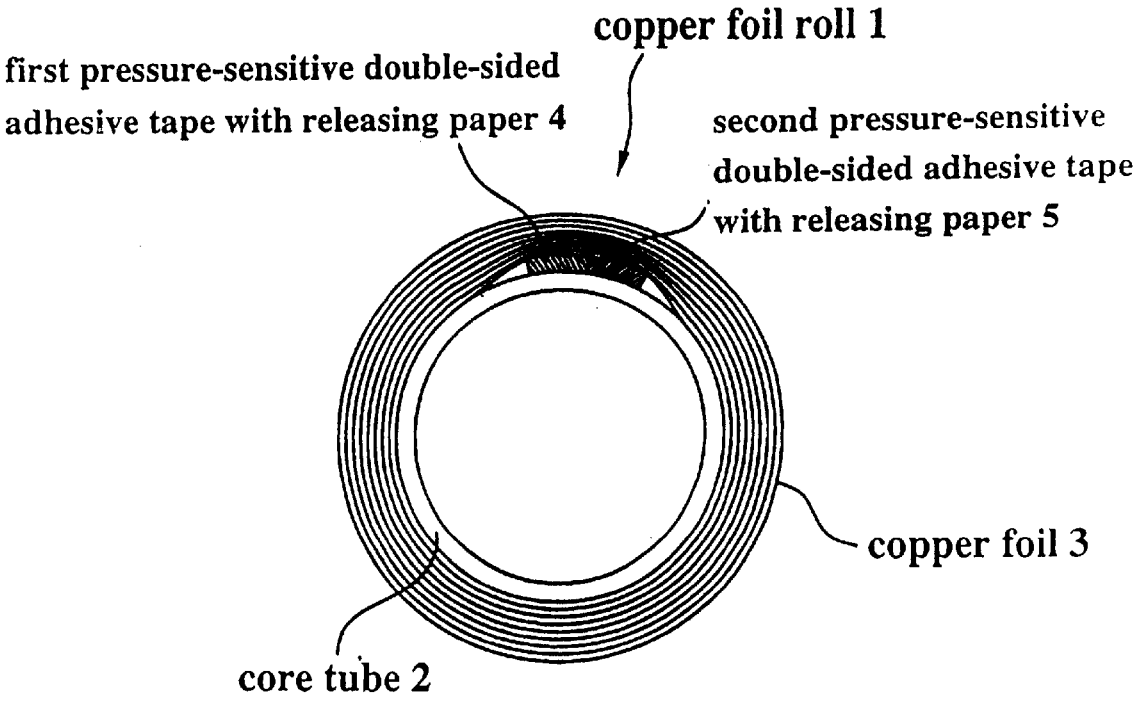

Subsequently, a given tension of 40 kg was given to the copper foil 3 to wind the copper foil 3 at a winding speed of 80 m/min, by which the copper foil roll 1 was manufactured as shown in FIG. 4(*d*). This copper foil roll 1 was evaluated. The evaluation result revealed that the A and B evaluation values were 0.80 mm and 5 m, respectively, so that the copper foil roll 1 with very high winding accuracy could be manufactured.

Effects of the Invention

The use of the method for winding copper foil in accordance with the present invention offers a very good winding balance of both ends of the copper foil roll having been wound. Therefore, the copper foil unwound from the copper foil roll in this state exhibits superior straight running properties, so that strict control of running state is unnecessary in the continuous laminating process for copper-clad laminates. Also, since the length in which wrinkles generated in the vicinity of the core tube shortens, the copper foil length capable of being used really as a product increases, so that the work efficiency in the field of manufacture of copper-clad laminates is increased in the case where judgment is made totally, and also the yields in manufacturing products can be increased.

What is claimed is:

1. A method for winding copper foil on a core tube, in which copper foil is spliced to a core tube with use of a pressure-sensitive double-sided adhesive coated tape with releasing paper and is wound into a roll form, comprising the steps of:

affixing a first pressure-sensitive double-sided adhesive coated tape with releasing paper, which has a length equal to the width of copper foil being wound and a width of 15 to 50 mm to the outer peripheral surface of said core tube so that the lengthwise direction of said tape is parallel with the longitudinal axis of said core tube;

affixing a second pressure-sensitive double-sided adhesive coated tape with releasing paper, which has a length equal to that of said first pressure-sensitive double-sided adhesive coated tape with releasing paper and a width of 15 to 50 mm to the outer peripheral surface of said core tube, like said first pressure-sensitive double-sided adhesive coated tape with releasing paper, so as to be adjacent to the winding rotation side of said first pressure-sensitive double-sided adhesive coated tape with releasing paper;

removing the releasing paper of said first pressure-sensitive double-sided adhesive coated tape with releasing paper, and affixing a winding-start end portion of said copper foil to said first pressure-sensitive double-sided adhesive coated tape with releasing paper in such a manner that the winding-start end portion of said copper foil does not cover said second pressure-sensitive double-sided adhesive coated tape with releasing paper;

removing the releasing paper of said second pressure-sensitive double-sided adhesive coated tape with releasing paper, rotating said core tube one substantially complete turn in a state in which said copper foil is under tension, and ceasing the rotation temporarily at a position at which said copper foil laps on said second pressure-sensitive double-sided adhesive coated tape with releasing paper;

bonding said copper foil to said core tube by applying a pressure to a bonding portion so that said copper foil bonds sufficiently to said second pressure-sensitive double-sided adhesive coated tape with releasing paper, thereby performing splicing operation in which said copper foil on the winding-start end portion side is wound and fixed on said core tube; and winding said copper foil into a roll form.

2. The method for winding copper foil on a core tube according to claim 1, wherein said first and second pressure-sensitive double-sided adhesive coated tapes with releasing paper each comprise a releasing paper and an adhesive layer with a thickness of 10 to 50 $\mu$m.

3. The method for winding copper foil on a core tube according to claim 1, wherein said core tube has an outside diameter of 110 to 350 mm and a roundness of 150 $\mu$m or less.

4. The method for winding copper foil on a core tube according to claim 1, wherein said core tube has an outer peripheral surface with a surface roughness (Rmax) of 10 to 30 $\mu$m.

5. The method for winding copper foil on a core tube according to claim 1, wherein variations of area weight in the transverse direction of said copper foil are within 5%.

6. The method for winding copper foil on a core tube according to claim 2, wherein said core tube has an outside diameter of 110 to 350 mm and a roundness of 150 $\mu$m or less.

7. The method for winding copper foil on a core tube according to claim 2, wherein said core tube has an outer peripheral surface with a surface roughness (Rmax) of 10 to 30 $\mu$m.

8. The method for winding copper foil on a core tube according to claim 3, wherein said core tube has an outer peripheral surface with a surface roughness (Rmax) of 10 to 30 $\mu$m.

9. The method for winding copper foil on a core tube according to claim 6, wherein said core tube has an outer peripheral surface with a roughness (Rmax) of 10 to 30 $\mu$m.

10. The method for winding copper foil on a core tube according to claim 2, wherein variations of area weight in the transverse direction of said copper foil are within 5%.

11. The method for winding copper foil on a core tube according to claim 3, wherein variations of area weight in the transverse direction of said copper foil are within 5%.

12. The method for winding copper foil on a core tube according to claim 4, wherein variations of area weight in the transverse direction of said copper foil are within 5%.

13. The method for winding copper foil on a core tube according to claim 6, wherein variations of area weight in the transverse direction of said copper foil are within 5%.

14. The method for winding copper foil on a core tube according to claim 7, wherein variations of area weight in the transverse direction of said copper foil are within 5%.

15. The method for winding copper foil on a core tube according to claim 8, wherein variations of area weight in the transverse direction of said copper foil are within 5%.

16. The method for winding copper foil on a core tube according to claim 9, wherein variations of area weight in the transverse direction of said copper foil are within 5%.

17. The method of claim 1, wherein said copper foil has a thickness of from about 9 $\mu$m to 90 $\mu$m.

18. The method of claim 1, wherein said copper foil has a thickness of 18 $\mu$m.

19. The method of claim 1, wherein said core tube comprises fiber reinforced plastic.

20. The method of claim 1, wherein said core tube comprises metal.

* * * * *